US006074184A

United States Patent [19]

Imai

[11] Patent Number: 6,074,184

[45] **Date of Patent: *Jun. 13, 2000**

[54] PUMP UTILIZING HELICAL SEAL

[76] Inventor: Atsushi Imai, 1-24, Miyado 1-chome, Asaka-shi Saitama, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/910,894

[22] Filed: Aug. 13, 1997

[30] Foreign Application Priority Data

Aug. 20, 1996 [JP] Japan ..... 8-237297

[51] Int. Cl.[7] ..... F04C 2/00

[52] U.S. Cl. ..... 418/54; 418/220

[58] Field of Search ..... 418/54, 55.1, 220

[56] References Cited

U.S. PATENT DOCUMENTS

| | | | |
|---|---|---|---|
| 2,358,721 | 9/1944 | Ljungdahl | 418/55.1 |
| 2,764,101 | 9/1956 | Rand | 418/55.1 |
| 3,274,944 | 9/1966 | Parsons | 418/55.1 |
| 3,853,434 | 12/1974 | Parsons | 418/55.1 |
| 5,174,737 | 12/1992 | Sakata et al. | 418/220 |

FOREIGN PATENT DOCUMENTS

| | | |
|---|---|---|
| 50-22310 | 3/1975 | Japan . |
| 52-111007 | 9/1977 | Japan . |
| 54-14008 | 2/1979 | Japan . |
| 63-67496 | 3/1988 | Japan . |
| 63-163067 | 7/1988 | Japan . |
| 2-201097 | 8/1990 | Japan . |
| 4-314987 | 11/1992 | Japan . |
| 5-1689 | 1/1993 | Japan . |
| 5-39789 | 2/1993 | Japan . |
| 5-280479 | 10/1993 | Japan . |
| 7-35068 | 2/1995 | Japan . |
| 7-224776 | 8/1995 | Japan . |

*Primary Examiner*—John J. Vrablik

*Attorney, Agent, or Firm*—McCormick, Paulding & Huber LLP

[57] ABSTRACT

A pump utilizing a helical seal comprises a barrel member 4, a cylindrical core member 1 eccentrically arranged in said barrel member 4 and a helical seal 3 arranged between said cylindrical core member 1 and said barrel member 4. As the barrel member 4 and the cylindrical core member 1 are made to revolve relative to each other, the helical fluid path defined by the helical seal, the cylindrical core member 1 and the barrel member changes its capacity and the fluid contained in the barrel member is forced to axially move. Thus, the fluid is subjected not only to the axial force but also to the pressure that increases as the capacity of the helical fluid path formed by the helical seal is reduced by the relative revolution of the cylindrical core member 1 and the barrel member 4.

4 Claims, 3 Drawing Sheets

PUMP UTILIZING HELICAL SEAL

BACKGROUND OF THE INVENTION

1. Field of the Invention

This invention relates to a pump utilizing a helical seal arranged between the inner peripheral surface of a barrel member and the outer peripheral wall of a cylindrical core member eccentrically inserted into the barrel member so that the capacity of an airtight helical fluid path defined by the helical seal, the barrel member and the cylindrical core member is made to continuously change as the helical seal is rotated (including rotation and revolution due to the relative rotary motion of the cylindrical core member and the barrel member) and the liquid introduced into the helical fluid path is forcibly discharged from an axial end of the barrel member.

2. Related Art Statement

Known devices comprising a barrel member and a cylindrical core member concentrically housed in a barrel member to define a helical fluid path at the contacting surface portion of the members for transforming fluid energy include (1) those designed to control the pressure or the flow rate of fluid flowing through the helical fluid path, (2) those designed to operate as a pump that forces the fluid in the helical fluid path to move forward by rotating either of the members on which the helical fluid path is arranged and (3) those designed to operate as a hydraulic turbine that causes pressurized fluid to flow through the helical fluid path in order to drive either of the members on which the helical fluid path is arranged to rotate. More specifically, known devices of the types under consideration includes a fluid control device disclosed in Japanese Patent Application Laid-Open No. 63-67496 and a rotary transmission device disclosed in Japanese Patent Application Laid-Open No. 63-163067.

The inventor of the present invention has proposed a fluid energy transforming device comprising a barrel member, a cylindrical core member concentrically housed in the barrel member and a helical seal fitted into a helical groove provided at the contacting surface portion of the members so that the device may operate as a pump. As the barrel member or the cylindrical core member is driven to rotate, the helical seal revolves to make the fluid flowing through the helical fluid path along the helical seal subjected to an axial pushing force to raise the pressure of the fluid.

Known pumps utilizing a helical groove include a stator for an eccentric screw pump disclosed in Japanese Patent Application Laid-Open No. 50-22310 and a displacement axial-flow rotary piston disclosed in Japanese Patent Application Laid-Open No. 54-14008, which are designed to apply pressure to and discharge fluid by revolving a helical groove.

Finally, known fluid compressors comprising a helical groove include ones disclosed in Japanese Patent Applications Laid-Open Nos. 5-280478, 7-224776, 4-314987, 2-201097, 5-39789 and 7-35068. These compressors are also provided with a helical groove that revolves to generate pressure. Of these, some comprise a revolving member having a helical groove and contained in an outer case eccentrically while others comprise a helical groove arranged with a reducing pitch. Japanese Patent Application Laid-Open No. 5-1689 discloses a horizontal compressor type oil feeder comprising a helical flow path.

In any known devices comprising a helical seal arranged at the contacting surface portion between a barrel member and a cylindrical core member and designed to raise the pressure being applied to fluid flowing along the helical seal by revolving the helical seal, the cylindrical core member is concentrically arranged in the barrel member. With such an arrangement, only the axial pushing force generated by the revolving helical seal is used to increase the pressure being applied to the fluid contained in the barrel member and hence such an device is poorly adapted to raise the pressure being applied to the fluid.

SUMMARY OF THE INVENTION

The object of the present invention is to provide a pump adapted to raise the pressure being applied to the fluid contained therein not only by using an axial pushing force generated by the helical seal it comprises but also by changing the capacity of the helical fluid path (helical groove) produced by the helical seal.

According to an aspect of the invention, the above object is achieved by providing a pump utilizing a helical seal that comprises a cylindrical barrel member provided at the axial opposite ends thereof with closures and a cylindrical core member having a diameter slightly smaller than the inner diameter of the barrel member and eccentrically housed in the barrel member, said cylindrical core member being provided on the outer peripheral surface with a helical groove for receiving therein a helical seal to define a helical fluid path between each winding portion of the helical seal. With such an arrangement, the pump can raise the pressure it applies to the fluid (liquid or gas) introduced into the barrel member by rotating the cylindrical core member around a rotary axis displaced from the rotary axis of the barrel member, or by eccentrically revolving it along the inner peripheral surface of the barrel member, or by eccentrically revolving the barrel member along the outer peripheral surface of the cylindrical core member.

According to another aspect of the invention, a pump utilizing a barrel member comprises a cylindrical barrel member provided at the axial opposite ends thereof with closures and a cylindrical core member having a diameter slightly smaller than the inner diameter of the barrel member and eccentrically housed in the barrel member, said barrel member being provided on the inner peripheral surface with a helical groove for receiving therein a helical seal to define a helical fluid path between each winding portion of the helical seal. With such an arrangement, the pump can raise the pressure it applies to the fluid (liquid or gas) introduced into the barrel member by revolving the barrel member on its rotary axis displaced from the rotary axis of the cylindrical core member, or by revolving the cylindrical core member along the inner peripheral surface of the barrel member, or by eccentrically revolving the barrel member along the outer peripheral surface of the cylindrical core member.

With any of the above arrangements, a cylindrical core member is eccentrically housed in a barrel member and a helical seal is arranged between them. Since the helical seal is provided between the members, the cylindrical core member may revolve relative to the barrel member along the inner peripheral surface of the latter or either the cylindrical core member or the barrel member may be eccentrically revolved (or rotated) relative to the other. Thus, the helical seal that revolves (or rotates) relative to either the cylindrical core member or the barrel member provides peripheral airtightness between the each helical seal due the principle disclosed in Japanese Patent No. 2515992. Namely, airtightness between the helical seal and the inner peripheral surface of the barrel member or the outer peripheral surface of the cylindrical core member is kept by the elastic force of the helical seal. Further, when the helical seal is provided on the the outer peripheral surface of the cylindrical core member, since the helical seal is expanded to the outer side by the rotation of the cylindrical core member, the airtightness is higher as the increase of the number of the rotation.

On the other hand, the helical seal is slid in the helical groove and tightly held therein by the axial pressure difference that arises among different windings of the helical seal or by the axial component of the force generated by the peripheral sliding motion of the helical seal. Thus, the axial pressure being applied to the fluid contained in the pump is raised by the helical seal operated as the above mentioned, and the pressure being applied to the fluid is further raised by the capacity of the helical fluid path defined by the helical seal, the cylindrical core member and the barrel member is continuously reduced by the eccentric revolution (or rotation) of the cylindrical core member relative to the barrel member.

The above described and other objects and novel feature of the present invention will become apparent more fully from the description of the following specification in conjunction with the accompanying drawings.

DESCRIPTION OF THE PREFERRED EMBODIMENTS

Figure 1:
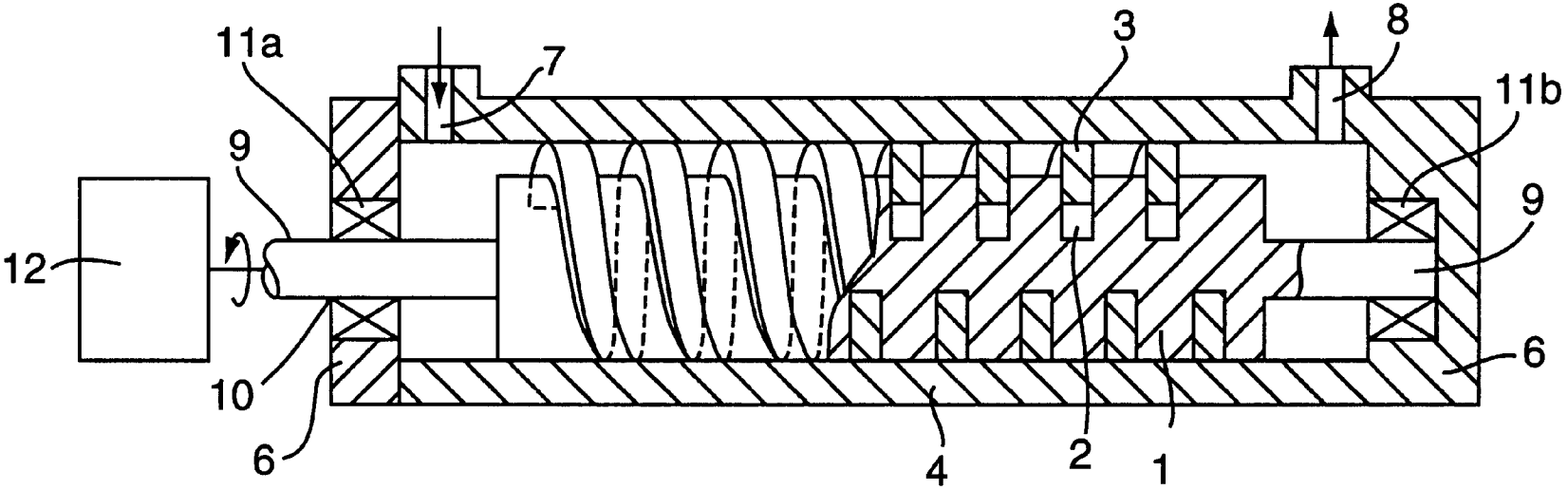
FIG. 1 shows a cross sectional view of a first embodiment of the invention.

Now, the present invention will be described in greater detail by referring to the accompanying drawings. FIG. 1 is a cross sectional view of a first embodiment of pump utilizing a helical seal according to the invention. It comprises a cylindrical core member 1 provided on the outer peripheral surface thereof with a helical groove 2, into which an elastically deformable helical seal 3 is inserted. The helical seal 3 may be made of any elastically deformable appropriate material such as hard rubber, plastic or metal. The helical groove 2 has a depth good for completely containing the helical seal 3. Additionally, the helical seal 3 is so arranged that it can completely dip into the helical groove 2 or partly come out of it as the helical seal 3 is driven to eccentrically rotate in a manner as will be described hereinafter. The cylindrical core member 1 is eccentrically housed in a cylindrical barrel member 4 such that the axis of the cylindrical core member 1 is arranged in parallel with and displaced by a short distance from that of the cylindrical barrel member 4. Thus, a helical fluid path is defined by the winding helical seal 3 between the barrel member 4 and the core member 1.

The barrel member 4 is closed at the axially opposite ends by means of respective closures 6, 6. Additionally, the barrel member 4 is provided with an inflow port 7 and an outflow port 8 arranged respectively in axially opposite end portions thereof. As the cylindrical core member 1 revolves, fluid can be introduced into the barrel member 4 through the inflow port 7. Thus, the fluid in the barrel member 4 is axially pushed toward the axial direction by the helical seal 3 due to the rotation of the core member 1, and the pressure of the fluid is raised as the fluid path changes its capacity so that it is eventually forced out through the outflow port 8.

The cylindrical core member 1 is provided at the axially opposite ends thereof with respective rotary shafts 9, 9. Each shaft is held respectively by respective bearings 11*a*, 11*b* arranged in respective central holes of the closures 6, 6. Since the rotary shafts 9, 9 are eccentrically arranged relative to the central axis of the barrel member 4, the core member 1 is driven to rotate around its eccentric rotary axis.

A motor 12 is used to drive the cylindrical core member 1 to rotate. One of the rotary shafts 9, 9 that is fitted to the core member 1 and running through the corresponding bearing 11*a* is linked to the motor 12. Note that, in this embodiment, only one of the rotary shafts 9, 9 runs through the corresponding bearing 11*a* and linked to a motor 12. In this embodiment, only this one of the rotary shafts 9, 9 projects outward from the corresponding closure 6 and, therefore, only this bearing 11*a* has to be airtightly arranged, whereas the other one of the rotary shafts 9, 9 is held by the corresponding bearing 11*b* arranged on the inside of the corresponding closure 6.

As the cylindrical core member 1 is driven to rotate, the helical seal 3 that rotates with the core member 1 forces the fluid that has entered the helical fluid path through the inflow port 7 to move axially and eventually go out of the barrel member 4 through the outflow port 8 under pressure because the capacity of the helical fluid path is changed as the core member 1 rotates. Note here that fluid is also introduced into the space between the helical seal 3 and the helical groove 2. The fluid is forced to move axially under pressure due to the volume change of the helical fluid path given rise to by the rotation of the core member 1.

Now, a second embodiment of pump utilizing a helical seal according to the invention will be described by referring to FIG. 2. As in the case of FIG. 1, the embodiment of FIG. 2 comprises a cylindrical core member 1 which is eccentrically housed in a cylindrical barrel member 4, whose axial opposite ends are closed by respective closures 6, 6, in such a way that the axis of the former is arranged in parallel with and displaced by a short distance from that of the latter. Additionally, the cylindrical core member 1 is provided on the outer peripheral surface thereof with a helical groove 2, into which an elastically deformable helical seal 3 is inserted. Thus, a helical fluid path is defined between the each adjacent winding convolution of the helical seal 3. The barrel member 4 is provided with an inflow port 7 and an outflow port 8 arranged respectively in axially opposite end portions thereof so that fluid can be introduced into the barrel member 4 through the inflow port 7 and driven out through the outflow port 8 by way of the helical fluid path.

The cylindrical core member 1 is further provided at the axially opposite ends thereof with respective eccentric cam couplings 21, 21, into which respective rotary shafts 9, 9 are inserted. Only one of the rotary shafts 9, 9 runs through the corresponding closure 6 of the barrel member 4 and linked to a motor 12, whereas the other one of the rotary shafts 9, 9 is held by the corresponding bearing 11*b* arranged in a hole on the inside of the corresponding closure 6. As shown in FIG. 2(*b*), each of the eccentric cam couplings 21, 21 comprises a sheath 21*a* having an eccentric through bore and a bearing 21*b* arranged in the through bore for holding the corresponding rotary shaft 9 running therethrough with the bearing 21*b* and sheath 21*a* being both rotationally fixed relative to the associated rotary shaft 9 so that, when the rotary shaft 9 linked to the motor 12 is driven to rotate by the motor 12, the core member 1 provided with the eccentric cam couplings 21, 21 revolves along the inner peripheral surface of the barrel member 4 without rotating on its own axis. The rotary shaft 9 linked to the motor 12 is held by the corresponding closure 6 by means of an airtight bearing 23.

With this embodiment of pump according to the invention and having a configuration as described above, the core member 1 is made to eccentrically revolve by the eccentric cam couplings 21, 21 as the rotary shaft 9 linked to the motor 12 is driven to rotate by the motor 12 so that the fluid contained in the pump is forced to move axially by the helical seal 3 fitted to the core member 1 and subjected to an increasing pressure as the helical fluid path reduces its capacity.

Now, a third embodiment of pump utilizing a helical seal according to the invention will be described by referring to FIG. 3. As in the case of FIG. 1, the embodiment of FIG. 3 comprises a cylindrical core member 1 which is eccentrically housed in a cylindrical barrel member 4, whose axial opposite ends are closed by respective closures 6, 6, in such a way that the axis of the former is arranged in parallel with and displaced by a short distance from that of the latter. Additionally, the cylindrical core member 1 is provided on the outer peripheral surface thereof with a helical groove 2, into which an elastically deformable helical seal 3 is inserted. Thus, a helical fluid path is defined between the each adjacent winding helical seal 3.

The cylindrical core member 1 is provided at the axially opposite ends thereof with respective spindles 31, 31 which project to the outside through the respective closures 6, 6 of the barrel member 4 and are rigidly held in position. An eccentric cam bearing (first cam bearing) 32 is arranged in the through bore of each of the closures 6, 6 through which the corresponding spindle 31 extends as shown in FIG. 3 (*b*). The eccentric cam bearing 32 of FIG. 3(*b*) comprises a sheath 32*a* having an eccentric through bore and a bearing 32*b* arranged in the through bore for holding the corresponding spindle 31 running therethrough. The eccentric cam bearings 32, 32 of this embodiment are airtightly held in position.

Another eccentric cam bearing (second cam bearing) 34 is arranged on the outer peripheral surface of the barrel member 4. Its eccentricity is exactly same as that of the eccentric cam bearings 32, 32 holding the respective spindles 31, 31. The eccentric cam bearing 34 is provided on the outer peripheral surface thereof with a peripheral ring 34*a,* which is by turn provided on the outer peripheral surface thereof with gear teeth 35 to make a wheel gear. The wheel gear is engaged with another wheel gear 36 driven by a motor 12 so that the barrel member 4 is driven to eccentrically revolve around the outer peripheral surface of the cylindrical core member 1 with its inner peripheral surface constantly held in contact with the outer peripheral surface of the core member 1. More specifically, the peripheral ring 34*a* is provided with an eccentric through bore for holding therein a bearing 34*b* so that the inner peripheral surface of the bearing 34*b* may be directly held in contact with the outer peripheral surface of the barrel member 4 and the barrel member 4 may be driven to eccentrically revolve around the spindles 31, 31. Since the barrel member 4 eccentrically revolves around its axis of revolution in this embodiment, the spindles 31, 31 are provided respectively with an inflow port 7*a* and an outflow port 8*a* located outside the barrel member 4 and communicating with the inside of the barrel member 4 through the respective closures 6, 6. Thus, the fluid introduced into the barrel member 4 through the inflow port 7*a* flows toward the outflow port 8*a* via the helical fluid path.

With this embodiment of pump according to the invention and having a configuration as described above, the barrel member 4 is driven by the motor 12 to eccentrically revolve around the outer peripheral surface of the core member 1 so that the core member 1 is made to relatively revolves as a result of this eccentric revolution. Therefore, as in the case of the preceding embodiments, the fluid introduced into the barrel member 4 is forced to axially move by the helical seal 3, and the pressure of the fluid is raised as the capacity of the helical fluid path is decreased by the revolution.

Figure 4:
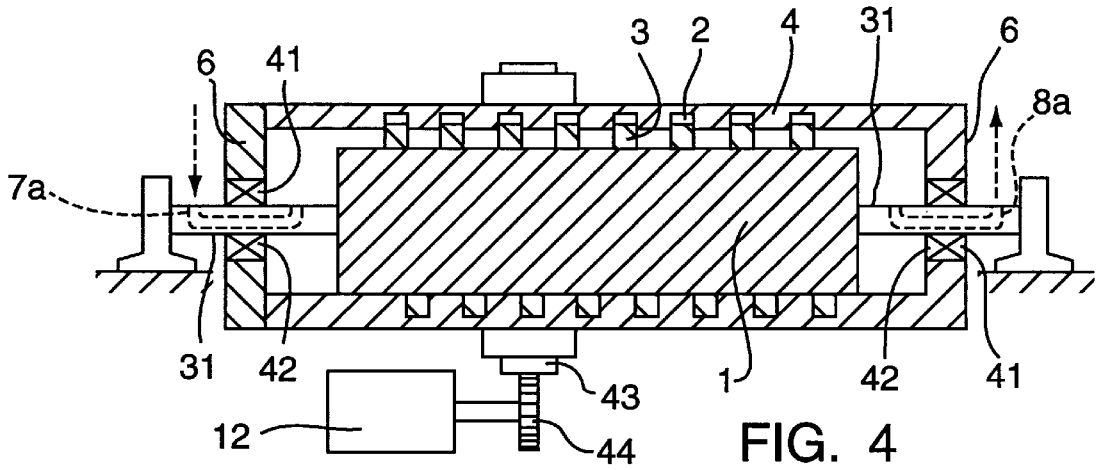
FIG. 4 shows a cross sectional view of a fourth embodiment of the invention.

Now, a fourth embodiment of pump utilizing a helical seal according to the invention will be described by referring to FIG. 4. The embodiment of FIG. 4 comprises a cylindrical core member 1 which is eccentrically housed in a cylindrical barrel member 4, whose axial opposite ends are closed by respective closures 6, 6, in such a way that the axis of the former is arranged in parallel with and displaced by a short distance from that of the latter. Additionally, the barrel member 4 is provided on the inner peripheral surface thereof with a helical groove 2, into which an elastically deformable helical seal 3 is inserted. Thus, a helical fluid path is defined between the each adjacent winding helical seal 3.

The cylindrical core member 1 is provided at the axially opposite ends thereof with respective eccentric spindles 31, 31 which project to the outside through respective central bores 41, 41 of the closures 6, 6 of the barrel member 4 and are rigidly held in position at the outside. An airtight bearing 42 is arranged in each of the central bores 41, 41 of the closures 6, 6 to rotatably hold the barrel member 4 so that the barrel member 4 may rotate on the spindles 31, 31. The barrel member 4 is provided on the outer peripheral surface with gear teeth 43 for driving the barrel member 4 to rotate, which gear teeth 43 is held in engagement with the gear teeth of a wheel gear 44 that is driven to rotate by a motor 12. The spindles 31, 31 are provided respectively with an inflow port 7*a* and an outflow port 8*a* located outside the barrel member 4 and communicating with the inside of the barrel member 4 through the respective closures 6, 6. Thus, the fluid introduced into the barrel member 4 through the inflow port 7*a* flows toward the outflow port 8*a* via the helical fluid path.

With this embodiment of pump according to the invention and having a configuration as described above, the barrel member 4 is driven by the motor 12 to rotate around the spindles 31, 31 so that helical seal 3 is also forced to eccentrically rotate around the core member 1. Therefore, as in the case of the preceding embodiments, the fluid introduced into the barrel member 4 is forced to axially move by the helical seal 3 and the pressure of the fluid is raised as the capacity of the helical fluid path is decreased by the revolution.

Figure 5:
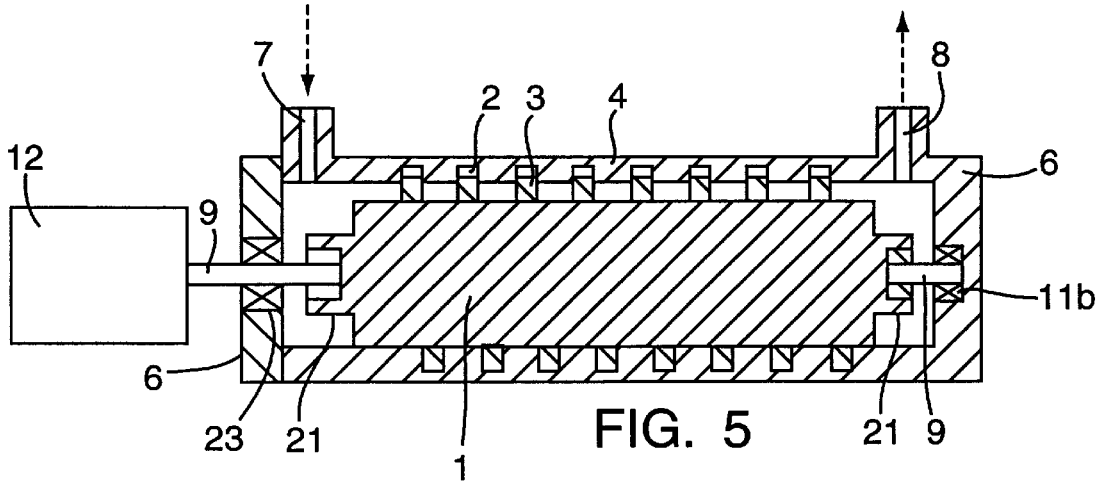
FIG. 5 shows a cross sectional view of a fifth embodiment of the invention.

Now, a fifth embodiment of pump utilizing a helical seal according to the invention will be described by referring to FIG. 5. As in the case of the embodiment of FIG. 4, this embodiment comprises a cylindrical core member 1 which is eccentrically housed in a cylindrical barrel member 4, whose axial opposite ends are closed by respective closures 6, 6, in such a way that the axis of the former is arranged in parallel with and displaced by a short distance from that of the latter. Additionally, the barrel member 4 is provided on the inner peripheral surface thereof with a helical groove 2, into which an elastically deformable helical seal 3 is inserted. Thus, a helical fluid path is defined between the each adjacent winding helical seal 3.

Figure 2A:
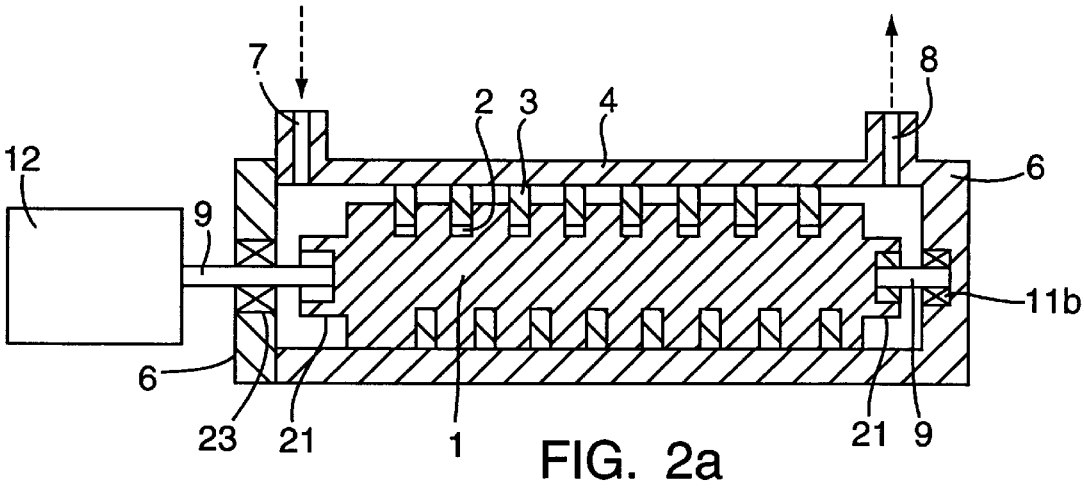
FIG. 2*a* shows a cross sectional view of a second embodiment of the invention and FIG. 2*b* shows a sectional view of the eccentric cam coupling thereof.
Figure 2B:
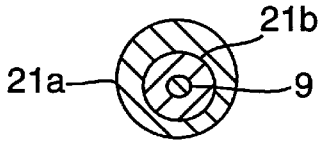

As in the case of FIG. 2, the cylindrical core member 1 is further provided at the axially opposite ends thereof with respective eccentric cam couplings 21, 21, each of which comprises a sheath 21*a* having an eccentric bore and a bearing 21*b* arranged in the eccentric bore for receiving the corresponding rotary shaft 9. One of the rotary shafts 9, 9 runs through the corresponding closure 6 of the barrel member 4 and linked to a motor 12, whereas the other one of the rotary shafts 9, 9 is held by a bearing 11*b* arranged in a hole formed in the corresponding closure 6. The rotary shafts 9, 9 have a common rotational axis parallel to and eccentrically spaced from the longitudinal axis of the barrel member 4. As the rotary shaft 9 is driven to rotate, the core member 1 is forced to revolve around the inner peripheral surface of the barrel member 4 by the eccentric cam couplings 21, 21 without rotating on its axis with the outer peripheral surface of the core member and the inner peripheral surface of the barrel member at each angular position of the rotary shafts having a point at which the spacing between the two peripheral surfaces is a minimum, which point of minimum spacing rotates relative to the barrel member with the rotation of the shafts and the value of which minimum spacing also varies with the rotation of the shafts. Note that the rotary shaft 9 linked to the motor 12 is airtightly held by a bearing 23 arranged in the corresponding closure 6. Additionally, the barrel member 4 is provided with an inflow port 7 and an outflow port 8 arranged respectively in axially opposite end portions thereof so that fluid can be introduced into the barrel member 4 through the inflow port 7 and driven out through the outflow port 8 by way of the helical fluid path.

With this embodiment of pump according to the invention and having a configuration as described above, the core member 1 is made to eccentrically revolve by the eccentric cam couplings 21, 21 as the rotary shaft 9 linked to the motor 12 is driven to rotate by the motor 12 so that the core member 1 is made to relatively revolves as a result of this eccentric revolution. Therefore, the fluid introduced into the barrel member 4 is forced to axially push by the helical seal 3, and the pressure of the fluid is raised as the capacity of the helical fluid path is decreased by the revolution.

Figure 6:
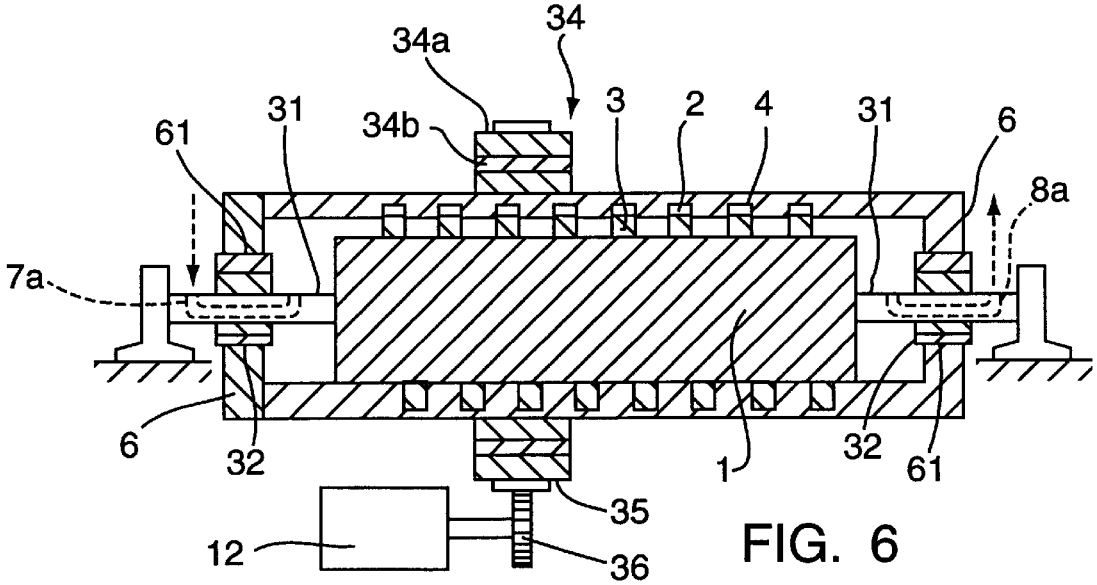
FIG. 6 shows a cross sectional view of a sixth embodiment of the invention.

Now, a sixth embodiment of pump utilizing a helical seal according to the invention will be described by referring to FIG. 6. This embodiment also comprises a cylindrical core member 1 which is eccentrically housed in a cylindrical barrel member 4, whose axial opposite ends are closed by respective closures 6, 6, in such a way that the axis of the former is arranged in parallel with and displaced by a short distance from that of the latter. Additionally, the barrel member 4 is provided on the inner peripheral surface thereof with a helical groove 2, into which an elastically deformable helical seal 3 is inserted. Thus, a helical fluid path is defined between the each adjacent winding helical seal 3.

The cylindrical core member 1 is provided at the axially opposite ends thereof with respective eccentric spindles 31, 31 which project to the outside through respective central bores 41, 41 of the closures 6, 6 of the barrel member 4 and are rigidly held in position at the outside. Each of the spindles 31, 31 is airtightly held in the corresponding closure 6 of the barrel member 4 by means of an eccentric cam bearing 32 arranged in the central bore 61 of the closure 6 as in the case of FIG. 3.

Figure 3A:
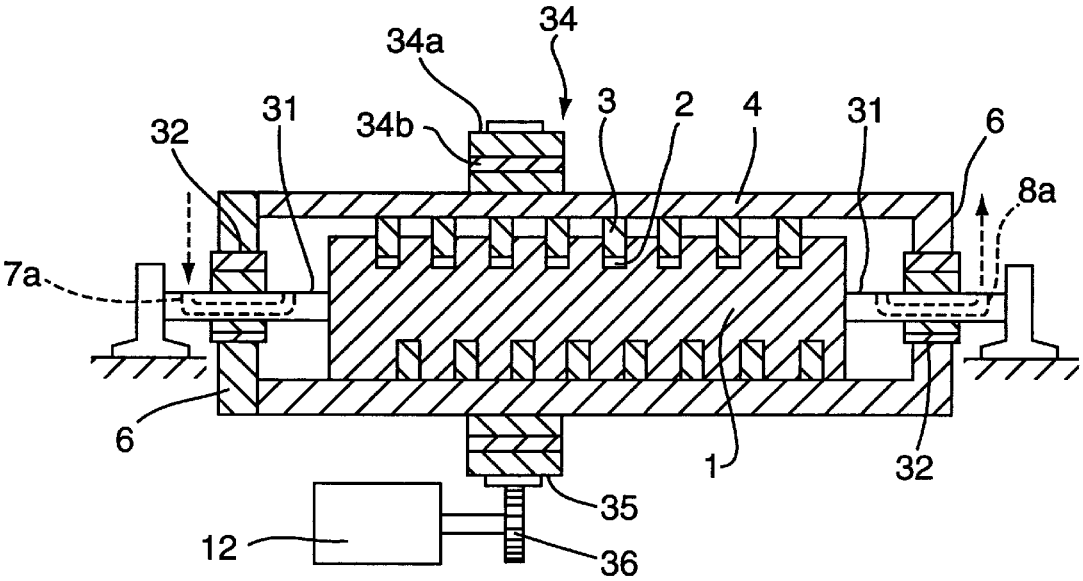
FIG. 3*a* shows a cross sectional view of a third embodiment of the invention and FIG. 3*b* shows a sectional view of the eccentric cam coupling thereof.
Figure 3B:
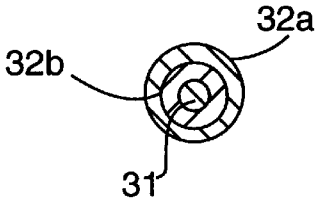

Another eccentric cam bearing 34 is arranged on the outer peripheral surface of the barrel member 4 to drive the barrel member 4 to revolve as in the case of FIG. 3 . The eccentric cam bearing 34 comprises a sheath 34*a,* which is provided on the outer peripheral surface thereof with gear teeth 35 to make a wheel gear. The wheel gear is engaged with another wheel gear 36 driven by a motor 12. The eccentricity of the eccentric cam bearing 34 is exactly same as that of the eccentric cam bearings 32, 32 holding the respective spindles 31, 31 so that the barrel member 4 may be driven to eccentrically revolve along the outer peripheral surface of the core member 1. Additionally, the spindles 31, 31 are provided respectively with an inflow port 7*a* and an outflow port 8*a* located outside the barrel member 4 and communicating with the inside of the barrel member 4 through the respective closures 6, 6. Thus, the fluid introduced into the barrel member 4 through the inflow port 7*a* flows toward the outflow port 8*a* via the helical fluid path.

With this embodiment of pump according to the invention and having a configuration as described above, the barrel member 4 is driven by the motor 12 to eccentrically revolve around the outer peripheral surface of the core member 1 so that the helical seal 3 is made to revolve also eccentrically. Therefore, the fluid introduced into the barrel member 4 is forced to axially push by the helical seal 3 that revolves with the barrel member 4, and the pressure of the fluid is raised as the capacity of the helical fluid path is decreased by the revolution.

Thus, according to the invention, a core member is eccentrically housed in a barrel member and a helical seal is arranged between the inner peripheral surface of the barrel member and the outer peripheral surface of the core member and made to eccentrically revolve (or rotate) relative to them, so that, since the fluid flowed along the helical seal is forced to move axially by the helical seal, and the capacity of the helical fluid path defined by the adjacent winding helical seals is continuously changed, it is possible to raise the pressure of the fluid larger. Additionally, since the core member and the barrel member are made to eccentrically revolve (or rotate), the pump can minimized the operation noise if compared with piston pumps, vane pumps, gear pumps and other pumps used to give rise to pressure intermittently.

While only one of the rotary shafts of the core member is driven to rotate in the first, second and fifth embodiments, alternatively both of the rotary shafts may be drive to rotate in a synchronized manner. Additionally, any of the eccentric cam joints and the eccentric cam bearings in the above embodiments may be replaced by joints and bearings of planetary gears that function similarly.

Detailed description has hereinabove been given of the invention achieved by the present inventor with reference to the embodiments. However, the present invention should not be limited to the embodiments described above and may be variously modified within the scope not departing from the gist.

What is claimed is:

1. A pump for pumping a given fluid material and utilizing a helical seal, said pump comprising:

a cylindrical barrel member having a longitudinal axis, said barrel member being closed at the axial opposite ends thereof with closures and having a cylindrical inner peripheral surface between said opposite ends;

a core member with a longitudinal axis, with axial opposite ends, and with a cylindrical outer peripheral surface having a diameter slightly smaller than the diameter of the inner peripheral surface of the barrel member, said core member being eccentrically housed in said barrel member with said longitudinal axes of said barrel member and of said core member parallel and radially spaced relative to one another;

a helical seal separate from said core member and slidably received on said outer peripheral surface of said core member, said helical seal being received by a helical groove in the inner peripheral surface of said barrel member;

said helical seal in its entirety being of helical shape with a number of convolutions;

said helical seal in combination with said outer peripheral surface of said core member and said inner peripheral surface of said barrel member defining a helical fluid path between any two adjacent convolutions thereof;

a pair of rotary shafts linked to the axial opposite ends of said core member by way of respective eccentric couplings and rotatably held by the respective closures of said barrel member so that said shafts have a common rotational axis parallel to and eccentrically spaced from the longitudinal axis of said barrel member, at least one of said rotary shafts being airtightly extending outwardly through the corresponding closure of said barrel member;

said eccentric couplings each including a sheath, with a cylindrical outer surface, rotationally fixed to a respective one of said rotary shafts with the axis of the cylindrical outer surface parallel to and eccentrically spaced from the longitudinal axis of the core member and with the cylindrical outer surface received in a conforming cylindrical inner surface of the core member which conforming inner surface is centered on the longitudinal axis of the core member;

a rotary drive unit linked to said rotary shaft airtightly extending through the corresponding closure to drive the sheath fixed to said rotary shaft airtightly extending through the corresponding closure and to thereby cause said core member to eccentrically revolve relative to the inner peripheral surface of the barrel member with the outer peripheral surface of the core member and the inner peripheral surface of the barrel member at each angular position of said rotary shafts having a point at which the spacing between said two peripheral surfaces is a minimum, which point of minimum spacing rotates relative to the barrel member with the rotation of said shafts and the value of which minimum spacing also varies with the rotation of said shafts;

an inflow port arranged in an end portion of said barrel member; and an outflow port arranged in another end portion of said barrel member and located axially opposite to said inflow port, whereby the fluid introduced into the barrel member through said inflow port is discharged through said outflow port under pressure due to the eccentric revolution of said core member;

said helical seal member being made of an elastically deformable material;

said helical seal having a flat radially inner surface held in engagement with the outer peripheral surface of said core member by the elasticity of said helical seal; and said helical seal and said helical groove having coengageable generally axially facing side walls which during operation of the pump are urged toward engagement with one another by the pressure of the pumped material, the slidability of the helical seal relative to the outer peripheral surface of the core member and/or the elasticity of the helical seal enabling said coengageable side walls to become tightly sealingly engaged with one another in response to said urging by the pressure of the pumped material.

2. A pump as defined in claim 1, wherein:

said helical seal is made of rubber.

3. A pump as defined in claim 1, wherein:

said helical seal is made of plastic.

4. A pump as defined in claim 1, wherein:

said helical seal is made of metal.

* * * * *